United States Patent [19]

Nagumo et al.

[11] 4,406,711

[45] Sep. 27, 1983

[54] METHOD FOR THE PRODUCTION OF HOMOGENEOUS STEEL

[75] Inventors: Michihiko Nagumo; Takeshi Kubota, both of Kawasaki; Keiji Konno, Ohita, all of Japan

[73] Assignee: Nippon Steel Corporation, Japan

[21] Appl. No.: 315,347

[22] Filed: Oct. 26, 1981

[30] Foreign Application Priority Data

Jun. 25, 1981 [JP] Japan ..... 56-97482

[51] Int. Cl.[3] ..... C21D 8/00

[52] U.S. Cl. ..... 148/2; 148/12 R; 148/12 F

[58] Field of Search ..... 148/2, 12 R, 12 F, 12 B

[56] References Cited

U.S. PATENT DOCUMENTS

| | | | |
|---|---|---|---|
| 4,137,104 | 1/1979 | Nashiwa et al. | 148/12 F |
| 4,184,898 | 1/1980 | Ouchi et al. | 148/12 F |
| 4,325,748 | 4/1982 | Nashiwa et al. | 148/2 |

*Primary Examiner*—Peter K. Skiff

*Attorney, Agent, or Firm*—Wenderoth, Lind & Ponack

[57] ABSTRACT

A method for the production of a homogeneous steel with reduced segregation of its ingredients by providing a continuous steel cast or steel ingot, the steel consisting of C≦1.0%, Si≦1.0% and Mn=0.2–3.0% plus one or more than two elements consisting of V≦0.2%, Nb≦0.2%, Mo≦1.0%, Cu≦2.0%, Cr≦2.0%, Ni≦3.0%, B≦0.002%, Ti≦0.1%, Al≦0.1%, and Ca≦0.01%, and the balance Fe and other unavoidable impurities, all percentages being by weight, subjecting the steel casting to a primary hot working at more than 20% reduction of area at an austenitic temperature range of less than 1200° C. or at a temperature in the range from the $Ar_1$ temperature to the $Ac_3$ temperature in which two phases of austenite and ferrite coexist, and then to a soaking step wherein the core temperature of the steel casting stays at 1000° C. or higher for a period of 30 minutes or longer.

7 Claims, 2 Drawing Figures

METHOD FOR THE PRODUCTION OF HOMOGENEOUS STEEL

BACKGROUND OF THE INVENTION

A. Field of the Invention

The present invention relates to a method for the production of a homogeneous steel, more particularly to a method for the production of a steel having excellent resistance to cracking.

B. Description of the Prior Art

In general, segregation of alloy elements and impurity elements takes place within steel castings particularly within those produced by continuous casting (referred to as "CC" hereinafter) as well as other steel ingots in the course of solidification. Throughout specification, the term "casting" is used to include steel castings produced by CC and other "steel ingots" produced by the conventional steel casting methods. Particularly, in the CC casting, a segregation zone called the "central segregation zone" occurs in the central part of the casting in the direction of its thickness. Unless this segregation is eliminated or reduced in a subsequent step, it remains in the casting and causes various types of cracks. For instance, cracks tend to occur in the heat affected zone (HAZ), when a heavy plate obtained from a casting is welded even though careful attention was given to crack prevention in the design of the steel composition and the manufacturing processes. This is because the condition of the alloy in the central segregation zone is considerably different from the designed steel composition because of segregation of alloy elements and impurity elements.

The best way to prevent the segregation of alloy and impurity elements in a casting is to prevent it at the time of occurrence, namely, in the course of solidification after casting. However, with the present available steel casting techniques, it is difficult to prevent the segregation of alloy and impurity elements completely. Therefore, it is necessary to eliminate or reduce the segregation occurring in castings in subsequent working steps. In order to eliminate or reduce segregation caused in casting, there has been used a homogenizing treatment. This treatment comprises the step of heating the casting uniformly a temperature of 1250°-1300° C. so as to diffuse the segregated elements, thereby to eliminate or reduce the segregation.

However, if homogenizing treatment is to be used to adequately reduce segregation so as to obtain a steel having excellent resistance to cracks, it is necessary to considerably prolong the heat treatment. In view of this, a compromise is made from the viewpoint of productivity or production cost and a more practical heat treatment of around 10 hours is used.

Accordingly, adequate reduction of segregation is never achieved by the conventional method. Furthermore, since the temperature of the homogenizing treatment is high, in the range of 1200°-1300° C., it is disadvantageous from the viewpoint of production cost and energy-saving.

Steel stock has conventionally been produced by the blooming or slabbing of castings. The purpose of blooming or slabbing in this case is to adjust the size of the casting to obtain a steel stock which the rolling mill is capable of rolling into a product of predetermined size with good yield. Quite recently, there has been a tendency to reduce the heating and rolling temperatures in blooming or slabbing but the purpose of this is to save energy and not to reduce the segregation within the casting. On the contrary, it is usually considered that the lowering of both the heating and rolling temperatures in the blooming step has an adverse effect on the reduction of segregation. Besides, the step of reheating the casting after blooming is directed to heating it to the temperature required for subsequent rolling.

Quite recently, with a view to preventing the failure of line pipe steel caused by the penetration of hydrogen as a consequence of corrosion, a method for maintaining a CC casting at a temperature in the range of 1150°-1300° C. for a prolonged period of time has been proposed. Also, another method for obtaining a steel with a high toughness has been also proposed, in which the casting is rolled at a reduction ratio of more than 10%, then cooled to less than 750° C. on the average, and subsequently held at a temperature in the range of 750°-500° C. for more than 10 minutes in order to precipitate fine AlN. Neither of these methods is an effective means for eliminating the segregation of alloy or impurity elements in the steel.

SUMMARY OF THE INVENTION

Accordingly, it is an object of the present invention to provide a method for the production of a homogeneous steel with reduced segregation of alloy and impurity elements in the steel.

It is another object of the invention to provide a method for the production of a homogeneous steel with reduced segregation of alloy and impurity elements and having excellent resistance to hydrogen induced cracking.

It is still another object of the invention to provide a method for producing a steel stock of uniform quality by eliminating the segregation of alloy and impurity elements in the steel and producing a high carbon steel wire rod having superior drawability therefrom.

BRIEF DESCRIPTION OF THE DRAWINGS

Other and further objects of the invention will be better understood from the following detailed description with reference to the accompanying drawings, in which.

DETAILED DESCRIPTION OF THE INVENTION

Figure 1:
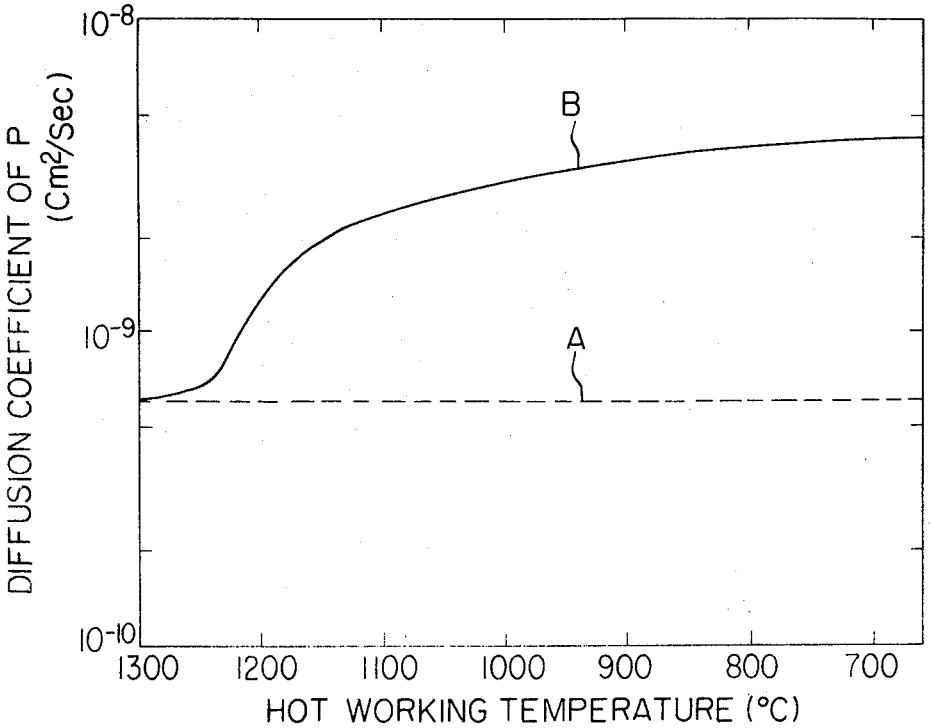
FIG. 1 is a graph showing the relationship between the effect on the diffusion coefficient by working, one of the factors affecting the diffusion of segregated elements, and the hot working temperature.

The present invention provides a steel stock substantially homogenized in quality which is conferred with excellent crack resistance by elimination or reduction of the segregation of alloying and impurity elements which constitutes one of the principal causes of cracking, in the casting from which the steel stock is produced by a heating and/or hot working process.

The invention is characterized by the provision of a homogeneous steel having uniform quality by eliminating the segregation of alloy and impurity elements which exist within the steel casting to such a degree that these elements become non-injurious to the steel quality. This is accomplished by subjecting the casting to a treatment at a lower temperature and for a shorter time than the diffusion treatment known as "homogenizing treatment".

The inventors have found that when a casting has been adequately worked at a relatively low temperature in the austenitic temperature range, the diffusion of segregated elements within the casting is greatly accelerated by a subsequent heating diffusion treating step.

In accordance with the invention, the method for producing a homogeneous steel comprises a series of steps of providing a casting of a steel consisting C≦1.0 weight (referred to as "wt" hereinafter)%, Si≦1.0 wt% and 0.2–3.0 wt% Mn added with one or more than two elements of V≦0.2 wt%, Nb≦0.2 wt%, Mo≦1.0 wt%, Cu≦2.0 wt%, Cr≦2.0 wt%, Ni≦3.0 wt%, B≦0.002 wt%, Ti≦0.1 wt%, Al≦0.1 wt%, and Ca≦0.01 wt%, and the balance Fe and other unavoidable impurities, subjecting the casting to a primary hot working step at more than 20% reduction of area at an austenitic temperature range of less than 1200° C., or at a temperature range from more than $Ar_1$ temperature to less than $Ac_3$ temperature in which two phases of austenite and ferrite coexist, and soaking the core temperature of the casting at 1000° C. or more for a period of 30 minutes or longer by continuously heating immediately after the primary hot working step or by reheating from a temperature lower than the end temperature of the primary hot working step. The above steel treated in this manner is called "primary homogeneous" steel hereinafter.

The invention also includes a method in which the primary homogeneous steel is cooled to a temperature lower than the $Ar_1$ temperature, and is then again reheated to a temperature higher than the $Ac_3$ temperature.

The invention further includes a method in which the primary homogeneous steel is subjected to a secondary hot working step.

The invention further includes a method in which the primary homogeneous steel is subjected to a secondary hot working step, then cooled to a temperature lower than the $Ar_1$ temperature and reheated to a temperature higher than the $Ac_3$ temperature.

By the $Ar_1$ temperature is meant the temperature at which the transformation from austenite to ferrite ends when iron or steel is cooled, and by the $Ac_3$ temperature is meant the temperature at which the transformation from ferrite to austenite ends when iron or steel is heated.

Now, the reason for the limits on the steel composition specified in the invention will be described hereinbelow.

First, as regards the chemical composition, C is added primarily as a deoxidizing agent and for maintaining the steel strength, and the amount thereof is specified as C≦1.0 wt% because if it exceeds 1.0 wt%, the significance of uniformity is lost because of the deterioration in toughness, weldability, etc. Si is also chiefly added as a deoxidizer and for maintaining the steel strength, and the preferred amount thereof is Si≦1.0 wt% for the same reasons as mentioned for C. Mn is chiefly added for the purpose of maintaining both strength and toughness, and it is found that if it is present at less than 0.2 wt%, it is not effective for maintaining strength while, if it exceeds 3.0 wt%, the toughness of the steel is deteriorated. V, Nb and Mo are principally added for the purpose of maintaining strength, and the addition of the elements at V≦0.2 wt%, Nb≦0.2 wt% and Mo≦1.0 wt% is preferred in review of both toughness and economy. Cu and Cr are chiefly added for the purpose of assuring corrosion resistance, and addition at Cu≦2.0 wt% and Cr≦2.0 wt% is preferred in order to preclude deterioration of workability and weldability. Ni is chiefly added for the purpose of assuring toughness and the amount thereof is specified as Ni≦3.0 wt% from the viewpoint of economy. B is chiefly added for the purpose of assuring hardenability and the amount thereof is specified as B≦0.002 wt% in order to preclude deterioration of toughness and weldabillity. Ti is chiefly added for the purpose of assuring toughness and the amount thereof is specified as Ti≦0.1 wt% in order to preclude deterioration of weldability. Al is chiefly added as a deoxidizer and also for maintaining toughness, and the amount thereof is specified as Al≦0.1 wt% in order to prelude deterioration of workability and weldability. Ca is chiefly added for the purpose of controlling the formation of non-metallic inclusions, and the amount thereof is specified as Ca≦0.01 wt% in order to preclude deterioration of workability and toughness.

The reason why the primary hot working temperature of the casting is limited to lower than 1200° C., preferably lower than 1150° C. is that if the primary hot working temperature should exceed 1200° C., the effect of the hot working would be quickly lost through the recovery of the steel and its recrystallization, and reduction of the segregation in the casting would not be effective to a satisfactory degree within the relatively short period of time in the subsequent heating diffusion step or homogenizing treatment step.

FIG. 1 is a graph showing the relationship between the effect of the hot working temperature on the diffusion coefficient, one of the factors affecting the diffusion of segregated elements. The graph shows the results of an experiment carried out in connection with a common steel of the Si-Mn system containing P as a segregated element. The casting was subjected to hot working at 45% reduction of cross-sectional area at various hot working temperatures and was thereafter heated at 1100° C. The broken line A refers to the diffusion coefficient of P at 1100° C. when the casting was not subjected to the hot working step while the solid line B refers to the diffusion coefficient of P when the casting was subjected to the hot working step. When the casting was subjected to hot working in advance, it is seen that the value of the diffusion coefficient in the subsequent soaking step was much higher than that when the casting was not subjected to hot working. The effect on the diffusion coefficient is seen to be remarkable at hot working temperatures lower than 1200° C., but that there is hardly any effect at temperatures above 1200° C.

It is preferable to subject a casting to hot working at a temperature in the range of austenite from the viewpoint of reducing resistance to deformation, and it may also be worked at a temperature in the range where two phases of austenite-ferrite coexist so as to increase the effect of working thereon. Particularly, when a casting is heated to carry out hot working, it is often practically beneficial if it is subjected to hot working before the whole body of the casting is austenitized. The greater the amount of primary hot working that the casting is given, the greater the effect of accelerating the diffusion of the segregated element in the following hot working step. Accordingly, in order to obtain a substantial effect, it is required that the casting be hot worked with more than 20% reduction of area. If the casting is subjected to primary hot working with less than 20% reduction of area, the diffusioning effect on the segregated element becomes insignificant.

Figure 2:
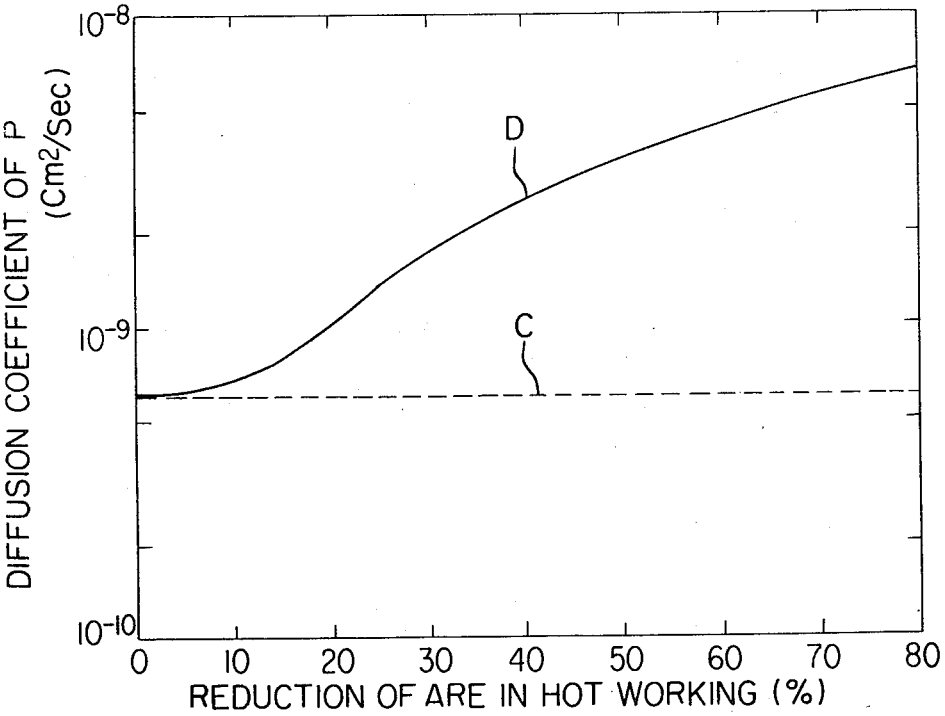
FIG. 2 is a graph showing the relationship between the diffusion coefficient and the amount of hot working.

FIG. 2 is a graph showing the relationship between the diffusion coefficient and the amount of hot working. As in FIG. 1, the graph shows the results of an experiment carried out in connection with a common steel of the Si-Mn system containing P as a segregated element. The casting was subjected to hot working at various reduction ratios at 1000° C. and was thereafter heated at 1100° C. The broken line C shows the diffusion coefficient of P at 1100° C. when the casting was not subjected to hot working while the solid line D shows the diffusion coefficient of P at 1100° C. when the casting was subjected to hot working. The effect of hot working on the diffusion coefficient is remarkable when the casting is subjected to hot working at more than 20% reduction of area, but there is hardly any effect at less than 20% reduction of area.

In carrying out primary hot working, the casting is first heated to the working temperature. However, when a CC casting is to be treated, it can instead be worked in the course of cooling after solidification. In the homogenizing diffusion treatment after primary hot working, the casting must be held at a core temperature higher than 1000° C. for a period longer than 30 minutes so that the diffusion of the segregated elements by means of defects introduced into the casting by the primary hot working can be satisfactorily effected. The amount of soaking time required depends on the condition of segregation (size of segregated domains, degree of segregation, type of segregated elements, etc.) in the casting and properties of the steel desired. For instance, it is necessary to hold a steel plate produced by the known CC method for a period of more than one hour in order to obtain a steel plate having good resistance to cracking when it is immersed in a saturated hydrogen sulfide solution with a pH of 3. Furthermore, when the soaking time becomes exceedingly long, the economical merit of the invention is lowered. Hence, the upper limit of the soaking time is preferably five hours. By "soaking time" is meant the total time required for effective diffusion within a specified temperature range, not the period of time that the casting is held at a given temperature. By "degree of segregation" is meant the ratio of the average concentration of an alloying or impurity element to the maximum concentration thereof in the segregated domains.

In transferring the casting from the primary hot working step to the subsequent homogenizing step, it may, in accordance with the set temperatures for the primary hot working step and homogenizing step, either be transferred continuously or after reheating. The temperature of the homogenizing treatment after the primary hot working has been specified as being higher than 1000° C., and the diffusion coefficient of the alloying and impurity elements varies continuously according to the temperature. It may be possible to homogenize the casting even at a temperature lower than 1000° C. if the soaking time is sufficiently prolonged. However, a long soaking time reduces the economical merit of the invention. It has been experimentally determined that the effect of diffusion acceleration is great when the temperature of the homogenizing treatment is higher than the temperature of the primary hot working. Hence it is effective to raise the temperature of the homogenizing treatment to higher than 1000° C. and higher than the starting temperature of the primary hot working step. Further, from the point of economy the upper limit temperature of the homogenizing step should be lower than 1250° C. When the austenitic crystal grains of the steel are coarsened by the above-mentioned homogenizing treatment and the toughness of the steel is reduced below that required, finer crystal grains and higher toughness can be obtained as follows. When the steel stock has been cooled to below the $Ar_1$ temperature after the homogenizing treatment, to transform it into ferrite, it is then reheated to a temperature higher than $Ac_3$ temperature and cooled, which is called "normalizing", it is quenched or quench-tempered after reheating. Any of these means is effective to improve toughness.

Secondary hot working conducted after the homogenizing treatment in no way affects the reduction of segregation. Therefore, in accordance with the properties required of the steel, such as formability or toughness, the casting may be subjected to such secondary hot working as rolling or forging after the homogenizing treatment. After secondary hot working, normalizing, hardening or tempering may be carried out additionally in order to reduce the crytal grain size.

As fully described in the foregoing, the present invention is directed to a method for producing a homogeneous steel by the combination of a primary hot working step with a high temperature soaking step and is substantially different from the prerolling method of the prior art in connection with CC castings.

In addition, the present invention can be applied to heavy plate, shapes, bar steel, wire rod, steel pipe etc.

Now, embodiments and examples of the invention will be described.

EXAMPLE 1

Steel stocks for line pipe having yield strengths of 42 kg/mm$^2$, 46 kg/mm$^2$ and 49 kg/mm$^2$ were produced from CC castings A, B and C having the chemical compositions indicated in Table 1.

TABLE 1

| Casting No. | C | Si | Mn | P | S | Nb | V (wt %) | Ti | Al | Ni | Cr | Cu | N | Mo |
|---|---|---|---|---|---|---|---|---|---|---|---|---|---|---|
| A | 0.10 | 0.24 | 1.29 | 0.017 | 0.004 | 0.012 | 0.055 | 0.002 | 0.024 | 0.01 | 0.02 | 0.01 | 0.0024 | — |
| B | 0.08 | 0.27 | 1.49 | 0.018 | 0.004 | 0.030 | 0.058 | 0.016 | 0.022 | 0.27 | — | — | 0.0038 | — |
| C | 0.07 | 0.26 | 1.55 | 0.015 | 0.003 | 0.041 | — | — | 0.028 | 0.27 | — | — | 0.0059 | 0.27 |

Line pipes are generally employed in wet hydrogen sulfide environment and are therefore susceptible to hydrogen induced cracks. Therefore, the steel composition the these pipes is devised to prevent hydrogen induced cracks. However, an alloy condition remarkably different from the design of the steel composition is caused by the segregation of alloy and impurity elements in the central segregation zone of the CC casting as described hereinbefore so that the hydrogen induced cracks tend to occur nevertheless. Therefore, to provide a steel free from hydrogen induced cracks, this invention was made, to, whereby a steel stock so homogenized in its properties that the remaining segregation has no adverse effect, is realized.

Tables 2, 3 and 4 show the conditions under which CC castings were heated and rolled to obtain steel stocks for producing line pipe, together with the results of hydrogen induced crack tests. The BP test was employed as the hydrogen induced crack test. In the BP test, the occurrence of hydrogen induced cracks is observed in a test sample immersed in Synthetic sea water saturated with hydrogen sulfide for a period of 96 hours. Sample No. 1 in each of Table 2, 3 and 4 was subjected to heating and rolling conditions that gave no consideration to eliminating or reducing the segregations existing in the castings. Each sample No. 2 was subjected to heating and rolling under conventional homogenizing treatment conditions for the reduction of segregations in a casting. The sample Nos. 3, 4, 5 and 6 are examples for comparison with this invention wherein: the reduction of area in the primary hot working of the casting was small (sample No.3); the temperature of the primary hot working of the casting was high (sample No.4); the homogenizing treatment was not conducted (sample No.5); and the temperature of the homogenizing treatment was low (sample No. 6). The sample Nos. 7–20 are examples treated in accordance with the method of the invention.

TABLE 2

| No. | Primary Hot Rolling: Reduction Rate (%) | Primary Hot Rolling: Rolling Temperature (°C.) | High Temperature Soaking Conditions (steel A): Core temperature of continuous casting or ingot | Secondary Hot Rolling: Reduction Rate (%) | Secondary Hot Rolling: Rolling Temperature (°C.) | Cool below $Ar_1$ temp. (°C.) | Reheat above $Ac_3$ temp. (°C.) | Finished sheet thickness (mm) | Length of Hydrogen induced crack (mm/cm$^2$) |
|---|---|---|---|---|---|---|---|---|---|
| 1 | — | — | — | 83 | 1200–800 | — | — | 20 | 3.2 |
| 2 | — | — | 1300° C. × 12 hours | 83 | 1200–800 | — | — | 20 | 0 |
| 3 | 10 | 1050–1000 | 1100° C. above × 30 min. | 81 | 1000–800 | — | — | 20 | 2.9 |
| 4 | 25 | 1250–1200 | 1250° C. above × 30 min. | 78 | 1000–800 | — | — | 20 | 2.8 |
| 5 | 25 | 1050–1000 | — | 78 | 1000–800 | — | — | 20 | 3.1 |
| 6 | 25 | 1050–1000 | 950° C. × 30 min. | 78 | 900–800 | — | — | 20 | 1.9 |
| 7 | 25 | 1050–1000 | 1000° C. above × 30 min. | 78 | 1000–800 | — | — | 20 | 0.1 |
| 8 | 25 | 1050–1000 | 1100° C. above × 30 min. | 78 | 1000–800 | — | — | 20 | 0 |
| 9 | 50 | 1050–1000 | 1100° C. above × 30 min. | 67 | 1000–800 | — | — | 20 | 0 |
| 10 | 50 | 1050–1000 | 1100° C. above × 30 min. | — | — | — | — | 20 | 0 |
| 11 | 25 | 1050–1000 | 1000° C. above × 30 min. | 78 | 1000–800 | room temp. | 900 | 20 | 0.2 |
| 12 | 25 | 1050–1000 | 1100° C. above × 30 min. | 78 | 1000–800 | room temp. | 900 | 20 | 0 |
| 13 | 50 | 1050–1000 | 1100° C. above × 30 min. | 67 | 1000–800 | room temp. | 900 | 20 | 0.1 |
| 14 | 50 | 1050–1000 | 1100° C. above × 30 min. | — | — | room temp. | 900 | 20 | 0 |
| 15 | 25 | 750–700 | 1100° C. above × 30 min. | 78 | 1000–800 | — | — | 20 | 0.1 |
| 16 | 50 | 750–700 | 1100° C. above × 30 min. | 67 | 1000–800 | — | — | 20 | 0 |
| 17 | 50 | 750–700 | 1100° C. above × 30 min. | — | — | — | — | 20 | 0 |
| 18 | 25 | 750–700 | 1100° C. above × 30 min. | 78 | 1000–800 | room temp. | 900 | 20 | 0 |
| 19 | 50 | 750–700 | 1100° C. above × 30 min. | 67 | 1000–800 | room temp. | 900 | 20 | 0.1 |
| 20 | 50 | 750–700 | 1100° C. above × 30 min. | — | — | room temp. | 900 | 20 | 0 |

TABLE 3

| No. | Primary Hot Rolling: Reduction Rate (%) | Primary Hot Rolling: Rolling Temperature (°C.) | High Temperature Soaking Conditions (steel B): Core temperature of continuous casting or ingot | Secondary Hot Rolling: Reduction Rate (%) | Secondary Hot Rolling: Rolling Temperature (°C.) | Cool below $Ar_1$ temp. (°C.) | Reheat above $Ac_3$ temp. (°C.) | Finished sheet thickness (mm) | Length of Hydrogen induced crack (mm/cm$^2$) |
|---|---|---|---|---|---|---|---|---|---|
| 1 | — | — | — | 83 | 1200–800 | — | — | 20 | 3.2 |
| 2 | — | — | 1300° C. × 24 hours | 83 | 1200–800 | — | — | 20 | 0 |
| 3 | 10 | 1050–1000 | 1100° C. above × 1 hour | 81 | 1000–800 | — | — | 20 | 2.9 |
| 4 | 25 | 1250–1200 | 1250° C. above × 1 hour | 78 | 1000–800 | — | — | 20 | 2.8 |
| 5 | 25 | 1050–1000 | — | 78 | 1000–800 | — | — | 20 | 3.1 |
| 6 | 25 | 1050–1000 | 950° C. × 1 hour | 78 | 900–800 | — | — | 20 | 1.9 |
| 7 | 25 | 1050–1000 | 1000° C. above × 1 hour | 78 | 1000–800 | — | — | 20 | 0.1 |
| 8 | 25 | 1050–1000 | 1100° C. above × 1 hour | 78 | 1000–800 | — | — | 20 | 0 |
| 9 | 50 | 1050–1000 | 1100° C. above × 1 hour | 67 | 1000–800 | — | — | 20 | 0 |
| 10 | 50 | 1050–1000 | 1100° C. above × 1 hour | — | — | — | — | 20 | 0 |
| 11 | 25 | 1050–1000 | 1000° C. above × 1 hour | 78 | 1000–800 | room temp. | 900 | 20 | 0.2 |
| 12 | 25 | 1050–1000 | 1100° C. above × 1 hour | 78 | 1000–800 | room temp. | 900 | 20 | 0 |
| 13 | 50 | 1050–1000 | 1100° C. above × 1 hour | 67 | 1000–800 | room temp. | 900 | 20 | 0.1 |
| 14 | 50 | 1050–1000 | 1100° C. above × 1 hour | — | — | room temp. | 900 | 20 | 0 |
| 15 | 25 | 750–700 | 1100° C. above × 1 hour | 78 | 1000–800 | — | — | 20 | 0.1 |
| 16 | 50 | 750–700 | 1100° C. above × 1 hour | 67 | 1000–800 | — | — | 20 | 0 |

TABLE 3-continued

| No. | Primary Hot Rolling Reduction Rate (%) | Primary Hot Rolling Rolling Temperature (°C.) | High Temperature Soaking Conditions (steel B) Core temperature of continuous casting or ingot | Secondary Hot Rolling Reduction Rate (%) | Secondary Hot Rolling Rolling Temperature (°C.) | Cool below $Ar_1$ temp. (°C.) | Reheat above $Ac_3$ temp. (°C.) | Finished sheet thickness (mm) | Length of Hydrogen induced crack (mm/cm²) |
|---|---|---|---|---|---|---|---|---|---|
| 17 | 50 | 750–700 | 1100° C. above × 1 hour | — | — | — | — | 20 | 0 |
| 18 | 25 | 750–700 | 1100° C. above × 1 hour | 78 | 1000–800 | room temp. | 900 | 20 | 0 |
| 19 | 50 | 750–700 | 1100° C. above × 1 hour | 67 | 1000–800 | room temp. | 900 | 20 | 0.1 |
| 20 | 50 | 750–700 | 1100° C. above × 1 hour | — | — | room temp. | 900 | 20 | 0 |

TABLE 4

| No. | Primary Hot Rolling Reduction Rate (%) | Primary Hot Rolling Rolling Temperature (°C.) | High Temperature Soaking Conditions (steel C) Core temperature of continuous casting or ingot | Secondary Hot Rolling Reduction Rate (%) | Secondary Hot Rolling Rolling Temperature (°C.) | Cool below $Ar_1$ temp. (°C.) | Reheat above $Ac_3$ temp. (°C.) | Finished sheet thickness (mm) | Length of Hydrogen induced crack (mm/cm²) |
|---|---|---|---|---|---|---|---|---|---|
| 1 | — | — | — | 83 | 1200–800 | — | — | 20 | 3.2 |
| 2 | — | — | 1300° C. × 36 hours | 83 | 1200–800 | — | — | 20 | 0 |
| 3 | 10 | 1050–1000 | 1100° C. above × 3 hours | 81 | 1000–800 | — | — | 20 | 2.9 |
| 4 | 25 | 1250–1200 | 1250° C. above × 3 hours | 78 | 1000–800 | — | — | 20 | 2.8 |
| 5 | 25 | 1050–1000 | — | 78 | 1000–800 | — | — | 20 | 3.1 |
| 6 | 25 | 1050–1000 | 950° C. × 3 hours | 78 | 900–800 | — | — | 20 | 1.9 |
| 7 | 25 | 1050–1000 | 1000° C. above × 3 hours | 78 | 1000–800 | — | — | 20 | 0.1 |
| 8 | 25 | 1050–1000 | 1100° C. above × 3 hours | 78 | 1000–800 | — | — | 20 | 0 |
| 9 | 50 | 1050–1000 | 1100° C. above × 3 hours | 67 | 1000–800 | — | — | 20 | 0 |
| 10 | 50 | 1050–1000 | 1100° C. above × 3 hours | — | — | — | — | 20 | 0 |
| 11 | 25 | 1050–1000 | 1000° C. above × 3 hours | 78 | 1000–800 | room temp. | 900 | 20 | 0.2 |
| 12 | 25 | 1050–1000 | 1100° C. above × 3 hours | 78 | 1000–800 | room temp. | 900 | 20 | 0 |
| 13 | 50 | 1050–1000 | 1100° C. above × 3 hours | 67 | 1000–800 | room temp. | 900 | 20 | 0.1 |
| 14 | 50 | 1050–1000 | 1100° C. above × 3 hours | — | — | room temp. | 900 | 20 | 0 |
| 15 | 25 | 750–700 | 1100° C. above × 3 hours | 78 | 1000–800 | — | — | 20 | 0.1 |
| 16 | 50 | 750–700 | 1100° C. above × 3 hours | 67 | 1000–800 | — | — | 20 | 0 |
| 17 | 50 | 750–700 | 1100° C. above × 3 hours | — | — | — | — | 20 | 0 |
| 18 | 25 | 750–700 | 1100° C. above × 3 hours | 78 | 1000–800 | room temp. | 900 | 20 | 0 |
| 19 | 50 | 750–700 | 1100° C. above × 3 hours | 67 | 1000–800 | room temp. | 900 | 20 | 0.1 |
| 20 | 50 | 750–700 | 1100° C. above × 3 hours | — | — | room temp. | 900 | 20 | 0 |

As is clearly shown in Tables 2, 3 and 4, by the method of this invention, the segregation existing within the casting can be reduced in a shorter time and at a lower temperature than is possible by the homogenizing treatment hitherto employed. It is possible to obtain a steel stock so uniform in quality that any remaining segregation has substantially no adverse effect on line pipe produced therefrom. Occurrence of hydrogen induced cracks is thus greatly prevented. A comparison of the results of the hydrogen induced crack tests for samples No.3 and 8 shows that the limit placed on the amount of primary hot working of the casting is justified.

Similarly, a comparison of the results of the hydrogen induced crack tests for samples No.4 and 8 shows that the limit placed on the hot working temperature is also justified. Furthermore, a comparison of the results of the hydrogen induced crack tests for sample Nos. 5, 6 and 7, 8 shows that the limit placed on the homogenizing treatment after the primary hot working is justified.

Sample No. 7 is an example wherein the core temperature of the casting in the homogenizing treatment was higher than 1000° C. and sample No.8 is an example wherein the core temperature was also higher than the starting temperature of the primary hot working.

As already mentioned hereinbefore, the required soaking time depends on the condition of segregation in the casting and desired properties of the steel stock to be produced. Therefore, in Tables 2, 3 and 4, the soaking times are specified as more than 30 minutes, more than one hour and less than five hours, respectively. In Tables 2, 3 and 4, and sample Nos. 10, 14, 17 and 20 refer to examples wherein no secondary hot rolling step was conducted after the soaking step.

As already mentioned, secondary hot rolling has no influence on the effect of the invention at all. The sample Nos. 15–20 are examples wherein the temperature of the primary hot working was in the temperature range where two phases of the ferrite-austenite coexist. The sample Nos. 11–14 and 18–20 are examples wherein the casting was held at a high temperature or subjected to secondary hot rolling, cooled to a temperature lower than the $Ar_1$ temperature, and then heated again to a temperature higher than the $Ac_3$ temperature. As indicated hereinbefore, after soaking or secondary hot rolling, it is beneficial to conduct an additional treatment such as normalizing or quenching-tempering since this helps to produce a finer crystal grain and improve the strength and toughness of the steel stock.

EXAMPLE 2

A hard steel wire rod was produced from a CC casting having the chemical composition shown in Table 5. The metallographic structure of the hard steel wire rod was basically pearlite. However, as the wire rod was produced from a CC casting, when it was subjected to patenting treatment after rolling, a micro-martensite structure tended to occur therein due to the segregation of Mn and C, etc. in the central segregation zone thereof. Micro-martensite existing in a wire rod will cause a rupture when the wire rod is drawn into wire. The present invention is capable of preventing such a rupture caused by the occurrence of micro-martensite at the time of wire drawing since it is able to eliminate or reduce the segregation of Mn and C, etc. in the central segregation zone. Table 6 indicates the heating and rolling conditions to which CC castings were subjected, and the existence of micro-martensite in the wire rod obtained after it was subjected to patenting. The average cooling rate in the patenting step was 12° C. per second (700°–400° C., air-cooling). In Table 6, sample No.1 is an example wherein no steps for eliminating or reducing the segregation existing in the casting were carried out. Sample No. 2 is an example wherein the segregation within the casting was reduced by the homogenizing treatment employed conventionally. Sample Nos. 3, 4, 5 and 6 are comparative examples wherein: the reduction of area in the primary hot working step of a casting was small (sample No.3); the temperature of the primary hot working step of a casting was high (sample No.4); no high temperature holding was conducted (sample No.5); and the temperature of the high temperature soaking was low (sample No.6).

Sample Nos. 7–9 are examples wherein the segregation within the casting was reduced by the method of the invention. As is clear from Table 6, the segregation of Mn, C, etc. within the casting can be reduced employing the method of the invention in a shorter time and at a lower temperature than is possible by the homogenizing treatment hitherto employed. Moreover, by this invention it is possible to obtain a hard steel wire rod in which the occurrence of a micro-martensite, one cause of rupture at the time of wire drawings, is prevented. Particularly, in the production of hard steel wire rod by the conventional homogenizing process, the excessively high treating temperature causes decarburization of the casting. The present invention is also highly effective in eliminating this problem.

TABLE 5

| (wt %) | | | | | | | |
|---|---|---|---|---|---|---|---|
| C | Si | Mn | P | S | Cu | Ni | Cr |
| 0.61 | 0.24 | 0.75 | 0.015 | 0.009 | 0.020 | 0.020 | 0.020 |

TABLE 6

| | Primary Hot Rolling | | High Temperature Soaking Conditions | Secondary Hot Rolling | | Diameter | Occurence |
|---|---|---|---|---|---|---|---|
| No. | Reduction of Area (%) | Rolling Temperature (°C.) | Core Temperature of Casting or Ingot | Reduction of Area (%) | Rolling Temperature (°C.) | of Finished Wire (mmϕ) | of Micro-martensite (*1) |
| 1 | — | — | — | 99.9 | 1050–1000 | 5.5 | x |
| 2 | — | — | 1300° C. × 24 hours | 99.9 | 1050–1000 | 5.5 | o |
| 3 | 10 | 1050–1000 | 1100° C. above × 1 hour | 99.9 | 1050–1000 | 5.5 | x |
| 4 | 25 | 1250–1200 | 1250° C. above × 1 hour | 99.9 | 1050–1000 | 5.5 | x |
| 5 | 25 | 1050–1000 | — | 99.9 | 1050–1000 | 5.5 | x |
| 6 | 25 | 1050–1000 | 950° C. × 1 hour | 99.9 | 900–850 | 5.5 | Δ |
| 7 | 25 | 1050–1000 | 1100° C. above × 1 hour | 99.9 | 1050–1000 | 5.5 | o |
| 8 | 40 | 1050–1000 | 1100° C. above × 1 hour | 99.8 | 1050–1000 | 5.5 | o |
| 9 | 40 | 1050–1000 | 1100° C. above × 1 hour | 99.8 | 1050–1000 | 5.5 | o |

(*1)
o: no occurence of micro-martensite,
Δ: partial occurence,
x: occurence.

We claim:

1. A method for the production of a homogeneous steel which comprises:

(a) providing a steel casting, said casting consisting of C≦1.0 weight %, Si≦1.0%, and 0.2–3.0 weight % Mn, one or more elements selected from the group consisting of V≦0.2 weight %, Nb≦0.2 weight %, Mo≦1.0 weight %, Cu≦2.0 weight %, Cr≦2.0 weight %, Ni≦3.0 weight %, B≦0.002 weight %, Ti≦0.1 weight %, Al≦0.1 weight %, Ca≦0.01 weight %, the balance Fe, and unavoidable impurities:

(b) subjecting said steel casting to a primary hot working step at more than 20% reduction of area at an austenitic temperature of less than 1200° C.;

(c) soaking said steel casting at a temperature at which the core temperature of said steel casting is maintained at 1000° C. or higher for a period of more than 30 minutes to 5 hours, by continuous heating, immediately subsequent to said primary hot working step (b), and (d) subjecting the steel of step (c) to secondary hot working whereby a region is formed wherein the diffusion coefficient of the segregations of both alloying and impurity elements is increased and wherein said segregations are removed from said steel casting in said region to obtain a steel having excellent resistance to cracks.

2. The method according to claim 1 in which said steel casting is subjected to said hot working step (b) in a temperature range of more than the $Ar_1$ temperature to less than the $Ac_3$ temperature wherein two phases of austenite and ferrite coexist.

3. The method according to claim 1 in which step (c) is conducted at a temperature higher than 1000° C. and higher than that of said hot working step (b)

4. The method according to claim 1 wherein after step (c) said steel casting is cooled to a temperature lower than the $Ar_1$ temperature and said steel is reheated to a temperature higher than the $Ac_3$ temperature.

5. The method according to claim 1 wherein after step (c) said steel casting is subjected to a secondary hot working step, thereafter said steel casting is cooled to a temperature lower than the $Ar_1$ temperature and subsequently, said steel casting is reheated to a temperature higher than the $Ac_3$ temperature.

6. The method according to claim 1 wherein the core temperature of said steel casting in step (c) stays at 1000° C. or higher for a period of at least one hour.

7. The method according to claim 1 wherein the temperature at which step (b) is performed is between 1000° and 1050° C.

* * * * *